US007686066B2

(12) United States Patent
Hirao

(10) Patent No.: US 7,686,066 B2
(45) Date of Patent: Mar. 30, 2010

(54) DIE AND METHOD OF MANUFACTURING CAST PRODUCT

(75) Inventor: Hiroaki Hirao, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/330,214

(22) Filed: Dec. 8, 2008

(65) Prior Publication Data

US 2009/0194249 A1 Aug. 6, 2009

(30) Foreign Application Priority Data

Jan. 31, 2008 (JP) ..... 2008-020946

(51) Int. Cl.
*B22D 17/08* (2006.01)
*B22D 17/22* (2006.01)

(52) U.S. Cl. ..... 164/113; 164/284; 164/312

(58) Field of Classification Search ..... 164/113, 164/284, 312, 133, 337, 137, 342
See application file for complete search history.

(56) References Cited

U.S. PATENT DOCUMENTS 7,025,114 B2 * 4/2006 Nagasaka et al. ..... 164/113

FOREIGN PATENT DOCUMENTS

| | | |
|---|---|---|
| JP | 09-267161 | 10/1997 |
| JP | 2001-179418 | 7/2001 |
| JP | 2002-011546 | 1/2002 |
| JP | 2002-045956 | 2/2002 |
| JP | 2003-048047 | 2/2003 |
| JP | 2005-000922 | 1/2005 |
| JP | 2005-254308 | 9/2005 |

OTHER PUBLICATIONS

Japanese Patent Application No. 2008-020946 Notice of Reasons for Rejection mailed Feb. 24, 2009 (English translation).

* cited by examiner

*Primary Examiner*—Kevin P Kerns
(74) *Attorney, Agent, or Firm*—Blakely Sokoloff Taylor & Zafman, LLP

(57) ABSTRACT

According to one embodiment, a die is provided with a stationary die and a movable die. When the movable die is combined with the stationary die, a biscuit section, a product section in which a product is to be cast, a main runner configured to guide a molten metal from the biscuit section toward the product section, a main gate provided between the main runner and the product section, a sub-runner diverging from the main runner and extending along a side edge part of the product section, and a sub-gate provided between the sub-runner and the product section are formed between the stationary die and the movable die. The sub-gate is connected to the side edge part in an end portion of the product section. The sub-runner extends beyond the product section in a direction in which the side edge part extends.

2 Claims, 7 Drawing Sheets

DIE AND METHOD OF MANUFACTURING CAST PRODUCT

CROSS-REFERENCE TO RELATED APPLICATIONS

This application is based upon and claims the benefit of priority from Japanese Patent Application No. 2008-020946, filed Jan. 31, 2008, the entire contents of which are incorporated herein by reference.

BACKGROUND

1. Field

One embodiment of the present invention relates to a technique associated with die casing.

2. Description of the Related Art

A cold-chamber die-casting die is provided with a biscuit section, product section, main runner, and main gate. The biscuit section receives a molten metal from an injection apparatus of a casting machine. The product section is a space in which a product is to be cast. The main runner guides the molten metal from the biscuit section toward the product section. The main gate is provided between the main runner and the product section and has a sharply reduced thickness such that the flow (i.e., stream) of the molten metal can be accelerated.

Since the solidification time of the molten metal of, for example, a magnesium alloy is very short, the die-casting die of which the cross-sectional flow area (i.e., cross-sectional area of a space into which the molten metal is to be poured) is small may possibly fail to fill the molten metal into every corner of the product section, thereby causing insufficient filling. Therefore, some die-casting dies that are liable to insufficient filling are provided with sub-runners and sub-gates that laterally support the flow in the product section, in addition to the main runner and the main gate.

A die that is provided with sub-gates around a product section is disclosed in Jpn. Pat. Appln. KOKAI Publication No. 2003-48047. In this die, the sub-gates are arranged beside the product section. A molten metal is poured into the product section directly and also through the sub-gates.

In recent years, there has been a growing demand for die-casting products with further reduced thicknesses, e.g., thicknesses of 0.6 mm or less.

In order to meet the above demand, the inventor hereof is trying to develop dies for thin-wall casting. In this process, the inventor found that air in one such thin-wall casting die was easily left between molten metal introduced through a main gate and molten metal introduced through sub-gates, and that defective casting, involving mold cavities, incomplete filling, or molten metal wrinkles, was liable to occur.

Since the die described in Jpn. Pat. Appln. KOKAI Publication No. 2003-48047 is provided with the sub-gates that surround the product section, air is easily left in the product section, so that it is difficult to reduce defective casting in this die.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Figure 1:
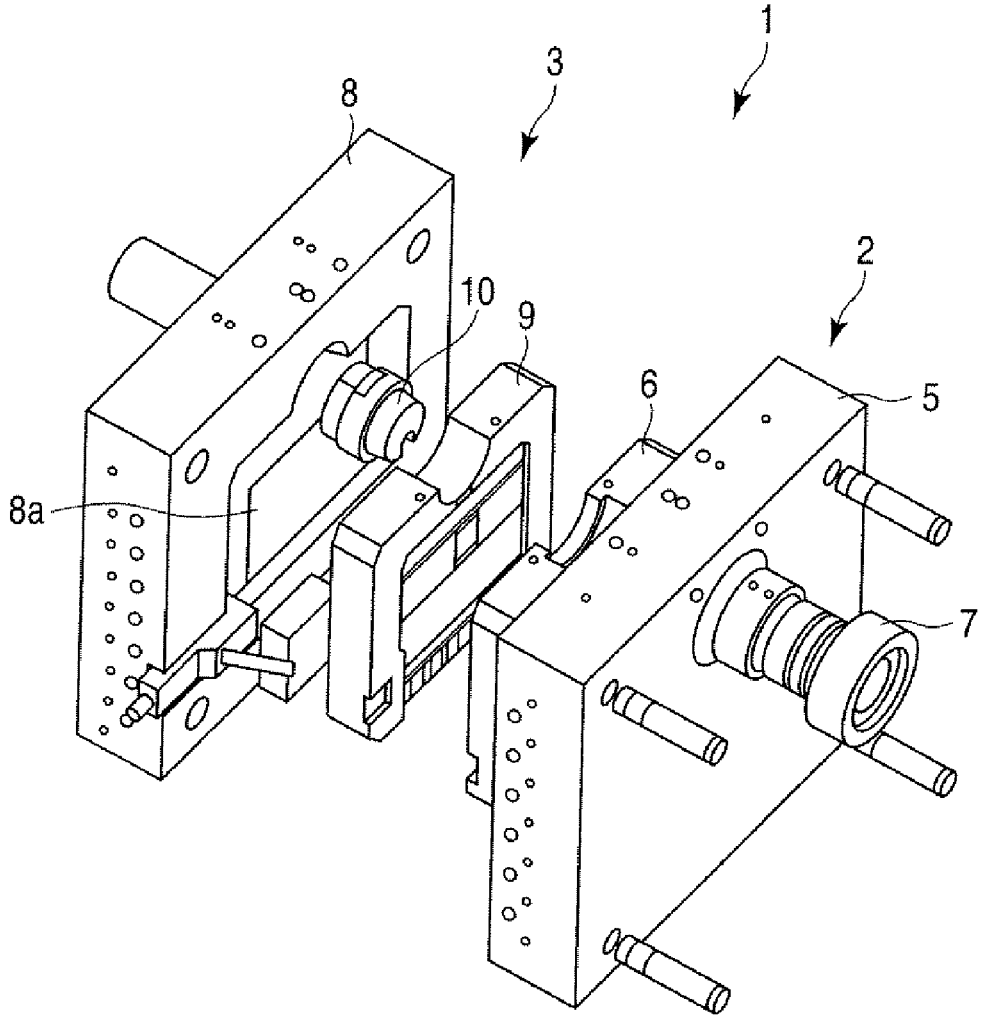
FIG. 1 is an exemplary perspective view of a die according to a first embodiment of the invention.

Various embodiments according to the invention will be described hereinafter with reference to the accompanying drawings. In general, according to one embodiment of the invention, a die for die casting comprising: a stationary die; and a movable die to be combined with the stationary die. When the movable die is combined with the stationary die, (i) a biscuit section into which molten metal is to be infused, (ii) a product section in which a product is to be cast, the product section including a main edge part, and a side edge part extending from an end portion of the main edge part, (iii) a main runner configured to guide the molten metal from the biscuit section toward the main-edge part of the product section, (iv) a main gate provided between the main runner and the main edge part of the product section and having a thickness smaller than that of the main runner, (v) a sub-runner diverging from the main runner and extending along the side edge part of the product section, and (vi) a sub-gate provided between the sub-runner and the side edge part of the product section and having a thickness smaller than that of the sub-runner are formed between the stationary die and the movable die. The product section includes a first end portion connecting with the main gate and a second end portion as an end portion of the product section opposite from the first end portion. The sub-gate is connected to the side edge part in the second end portion of the product section. The sub-runner extends beyond the product section in a direction in which the side edge part extends.

According to one embodiment of the invention, a method of manufacturing a cast product comprises preparing a die which includes a stationary die and a movable die to be combined with the stationary die, combining the movable die with a product section, and infusing molten metal into a biscuit section formed in the die. When the movable die is combined with the stationary die, (i) the biscuit section into which the molten metal is to be infused, (ii) the product section in which a product is to be cast, the product section including a main edge part, and a side edge part extending from an end portion of the main edge part, (iii) a main runner configured to guide the molten metal from the biscuit section toward the main edge part of the product section, (iv) a main gate provided between the main runner and the main edge part of the product section and having a thickness smaller than that of the main runner, (v) a sub-runner diverging from the main runner and extending along the side edge part of the product section, and (vi) a sub-gate provided between the sub-runner and the side edge part of the product section and having a thickness smaller than that of the sub-runner are formed between the stationary die and the movable die. The product section includes a first end portion connecting with the main gate and a second end portion as an end portion of the product section opposite from the first end portion. The sub-gate is connected to the side edge part in the second end portion of the product section. The sub-runner extends beyond the product section in a direction in which the side edge part extends.

First Embodiment

First, a die 1 and a method of manufacturing a cast product according to a first embodiment of the present invention will be described with reference to FIGS. 1 to 4.

FIG. 1 shows the die 1 according to the present embodiment. The die 1 is used for cold-chamber die casting, for example. Molten metal, such as a magnesium alloy, aluminum alloy, or zinc alloy, is poured into the die 1 under pressure. The die according to the present invention is not limited to those materials, and various materials may be widely used as the molten metal for die casing.

A cast product manufactured by using the die 1 is a component that forms a part of a housing of an electronic apparatus, such as a portable computer. The cast product of this type is a box-like structure that is provided with a bottom wall having, for example, a rectangular shape, and a standing wall rising from the peripheral edge portion of the bottom wall, and is open on one side. The cast product to which the present invention is applicable is not limited to the above example, and covers a wide variety of components.

An example of the cast product manufactured by the die 1 is a thin-walled product with a fundamental thickness of, for example, 0.6 mm or less. The "fundamental thickness" is a reference thickness of the product, that is, the most prevailing thickness that covers the product. The die according to the present invention may be used to cast a product of the fundamental thickness that exceeds 0.6 mm.

As shown in FIG. 1, the die 1 includes a stationary die 2 and a movable die 3 to be combined with the stationary die 2. The stationary die 2 is to be fixed to a stationary platen (not shown). The stationary die 2 includes a stationary die plate 5, a cavity member 6, and an inlet member 7.

The stationary die plate 5 is to be fixed to the stationary platen and is provided, on its surface opposed to the movable die 3, with a recess part (not shown) to which the cavity member 6 is attached. The cavity member 6 is attached to the recess part and opposed to the movable die 3. The cavity member 6 includes a die surface for forming, for example, an outer surface of the product. The inlet member 7 is provided with a through-hole into which an injection plunger of a casting machine is inserted, and is formed into a cylindrical shape.

On the other hand, the movable die 3 includes a movable die plate 8, a core member 9, and a dividing piece 10. The movable die 3 is to be fixed to a movable platen (not shown) and is movable between a die-closed position, in which the movable die 3 is combined with the stationary die 2, and a die-open position, in which the movable die 3 is separated from the stationary die 2.

The movable die plate 8 is to be fixed to the movable platen and is provided, on its surface opposed to the stationary die 2, with a recess part 8*a* to which the core member 9 is attached. The core member 9 is attached to the recess part 8*a* and opposed to the stationary die 2. The core member 9 includes a die surface for forming, for example, an inner surface of the product.

Figure 2:
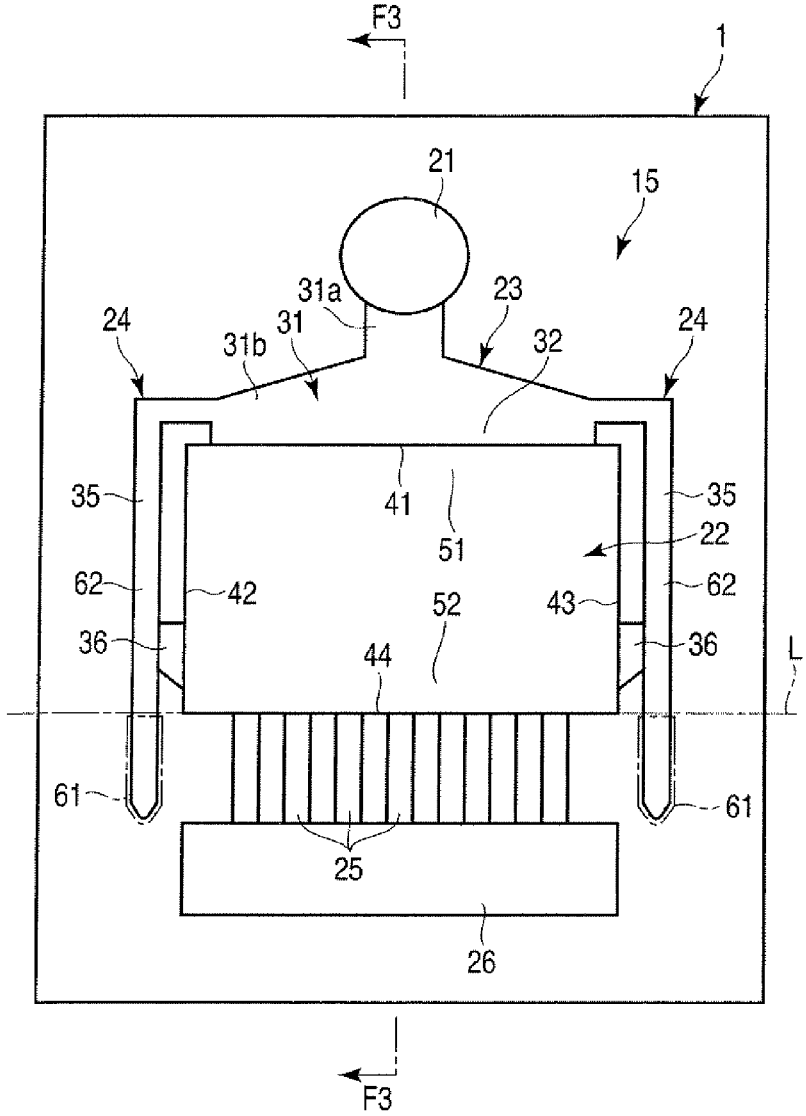
FIG. 2 is an exemplary view schematically showing the structure of an internal space of the die shown in FIG. 1.

When the movable die 3 is combined with the stationary die 2, an internal space 15 into which the molten metal is poured is formed between the stationary die 2 and the movable die 3. FIGS. 2 to 8 are exemplary views schematically showing the internal space 15 into which the molten metal flows, for convenience of explanation. In FIG. 2, the molten metal flows from above to below. In the description to follow, the vertical direction and the horizontal direction in the drawings will be referred to as an up-down direction (i.e., a stream direction of the molten metal) and a left-right direction, respectively.

As shown in FIG. 2, the internal space 15 in the die 1 includes a biscuit section 21, product section 22, fan gate 23, side gates 24, overflow section 25, and chillvent section 26. More specifically, the fan gate 23 includes a main runner 31 and a main gate 32. Each side gate 24 includes a sub-runner 35 and a sub-gate 36.

The biscuit section 21 is defined within the inlet member 7 and serves to receive a high-temperature molten metal from an injection apparatus of the casting machine at a high speed. That is, the molten metal is to be infused (i.e., poured) into the biscuit section 21.

The product section 22 is a space in which the product (i.e., cast product) is to be cast and is provided with a sunken surface corresponding to the shape of the product. As shown in FIG. 2, the product section 22 includes first, second, third, and fourth edge parts 41, 42, 43 and 44 corresponding individually to the four sides of the product.

The first edge part 41 is situated on the most upstream side of the product section 22 and extends in the horizontal direction in FIG. 2. The second and third edge parts 42 and 43 extend in the vertical direction in FIG. 2 from the opposite end portions of the first edge part 41. The fourth edge part 44 is situated on the most downstream side of the product section 22 and extends in the horizontal direction in FIG. 2 so as to be connected with end portions of the second and third edge parts 42 and 43. The first edge part 41 is a main edge part according to the present invention. Each of the second and third edge parts 42 and 43 is a side edge part according to the present invention.

As shown in FIG. 2, the product section 22 includes a first end portion 51 as an end portion on the molten metal filling starting side and a second end portion 52 as an end portion on the molten metal filling ending side. The first end portion 51 includes the first edge part 41 and connects with the main gate 32. The second end portion 52 is an end portion of the product section 22 opposite from the first end portion 51. The second end portion 52 includes the fourth edge part 44 and connects with the overflow section 25. The first and second end portions 51 and 52 not only correspond individually to edges of the product section 22 but include regions that adjoin the edges and have some breadth.

As shown in FIG. 2, the fan gate 23 is a channel through which a mainstream of the molten metal is guided to the product section 22. As mentioned before, the fan gate 23 includes the main runner 31 and the main gate 32. The main runner 31 is continuous with the biscuit section 21 and configured to guide the molten metal injected into the biscuit section 21 toward the first edge part 41 of the product section 22. The main runner 31 includes an upstream section 31*a* that connects with the biscuit section 21 and a downstream section 31*b* that connects with the main gate 32.

As shown in FIG. 2, the downstream section 31*b* of the main runner 31 is expanded larger than the upstream section 31*a* so that the molten metal can be guided to the entire product section 22. The downstream section 31*b* of the main runner 31 is expanded so as to be opposed to, for example, the greater part of the first edge part 41 of the product section 22. The main runner 31 has a thickness of, for example, 6 mm to 8 mm.

Figure 3:
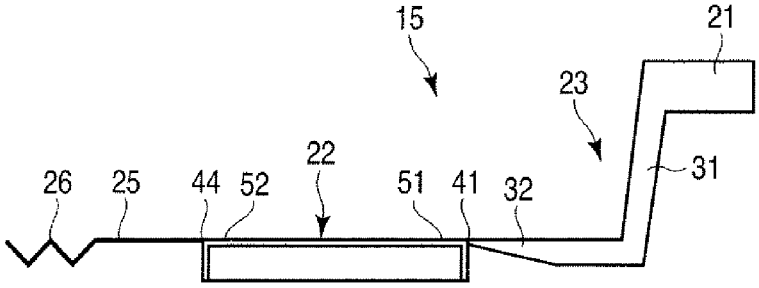
FIG. 3 is an exemplary sectional view of the internal space of the die taken along line F3-F3 of FIG. 2.

The main gate 32 is provided between the main runner 31 and the first edge part 41 of the product section 22. The main gate 32 has a thickness smaller than that of the main runner 31. As schematically shown in FIG. 3, the main gate 32 has its thickness sharply reduced toward the product section 22 and serves to accelerate the flow of the molten metal toward the product section 22. A minimum cross-sectional part of the main gate 32 has a thickness substantially equal to the fundamental thickness (e.g., 0.6 mm) of the product. The main gate 32 is provided on, for example, an extension of a space in which a bottom wall of the product is formed.

As shown in FIG. 2, the side gates 24 are auxiliary channels that support the flow in the product section 22. As mentioned before, each side gate 24 includes the sub-runner 35 and the sub-gate 36. In the present embodiment, the sub-runners 35 and the sub-gates 36 are arranged individually on the opposite sides, left and right, of the product section 22. Depending on the product shape, the sub-runner 35 and the sub-gate 36 may be provided only on one side, left or right, of the product section 22.

As shown in FIG. 2, the sub-runners 35 diverge individually from the opposite sides of the main runner 31, extend to the opposite sides of product section 22, and extend along the second and third edge parts 42 and 43 of the product section 22 on the sides thereof, respectively. The sub-runners 35 extend straight in the sides of the product section 22. Each sub-runner 35 has a thickness of, for example, 6 mm to 8 mm.

As shown in FIG. 2, the sub-gates 36 are provided individually between the sub-runners 35 and the second and third edge parts 42 and 43 of the product section 22 and laterally supply the molten metal to the product section 22. More specifically, the sub-gates 36 are connected individually to the second and third edge parts 42 and 43 in the second end portion 52 (i.e., end portion on the filling ending side) of the product section 22.

The number of sub-gates 36 is not limited to the above number. Specifically, additional sub-gates may be provided between the sub-runners 35 and the first end portion 51 or another portion of the product section 22, besides the sub-gates 36 between the sub-runners 35 and the second end portion 52 of the product section 22.

Each sub-gate 36 has a thickness smaller than that of each sub-runner 35. A minimum cross-sectional part of each sub-gate 36 has a thickness substantially equal to the fundamental thickness (e.g., 0.6 mm) of the product.

The sub-runners 35 according to the present invention will now be described in detail. As shown in FIG. 2, each sub-runner 35 includes an extension part 61 that extends beyond the product section 22 in a direction (vertical direction in FIG. 2) in which the second and third edge parts 42 and 43 extend. "To extend beyond the product section" implies to extend beyond a horizontal line L that passes through the fourth edge part 44 of the product section 22 (see FIG. 2). That is, the extension part 61 of each sub-runner 35 extends to an downstream side of the molten metal compared with the product section 22. The extension part 61 has the same flow cross-section as, for example, a part 62 of the sub-runner 35 that extends beside the product section 22, and extends straight from the part 62.

In the die 1 that is used to cast a housing component of a portable computer of the B5-size, for example, the extension part 61 extends for, e.g., about 100 mm beyond the product section 22. The extension part 61 is not limited to a specific length, and its length may be suitably set.

As shown in FIG. 2, the overflow section 25 and the chillvent section 26 are provided on the downstream side of the molten metal with respect to the product section 22. The overflow section 25 connects with the fourth edge part 44 of the product section 22. The overflow section 25 connects with the product section 22 on the side opposite from the main gate 32. The overflow section 25 receives air pushed out of the product section 22 by the molten metal so that the filling resistance of the molten metal is reduced and a degraded part of the molten metal at the flow tip can be pushed out of the product section 22. The chillvent section 26 serves as a sluice that prevents the degraded molten metal from running out of the die 1.

The following is a description of an example of a method of manufacturing the cast product using the die 1.

First, the die 1 is prepared and set in the casting machine. Further, a raw material (e.g., magnesium alloy) is melted into the molten metal. Subsequently, a casting cycle is started. First, the movable die 3 is moved to be combined with the stationary die 2 and the die 1 is clamped. Then, the molten metal is poured (i.e., infused) into a sleeve that is coupled to the inlet member 7, the injection plunger is pushed out at a high speed, and the molten metal is forced Into the biscuit section 21 of the die 1.

When the solidification of the cast product is advanced to a certain degree, the movable die 3 is moved to open the die, and the cast product is taken out of the die 1 by means of an eject pin or the like. Thereupon, one cycle of die casting is finished. A surplus part is removed from the cast product that is taken out of the die 1, whereupon a cast product with a desired shape is obtained.

The following is a description of the function of the die 1.

Figure 4:
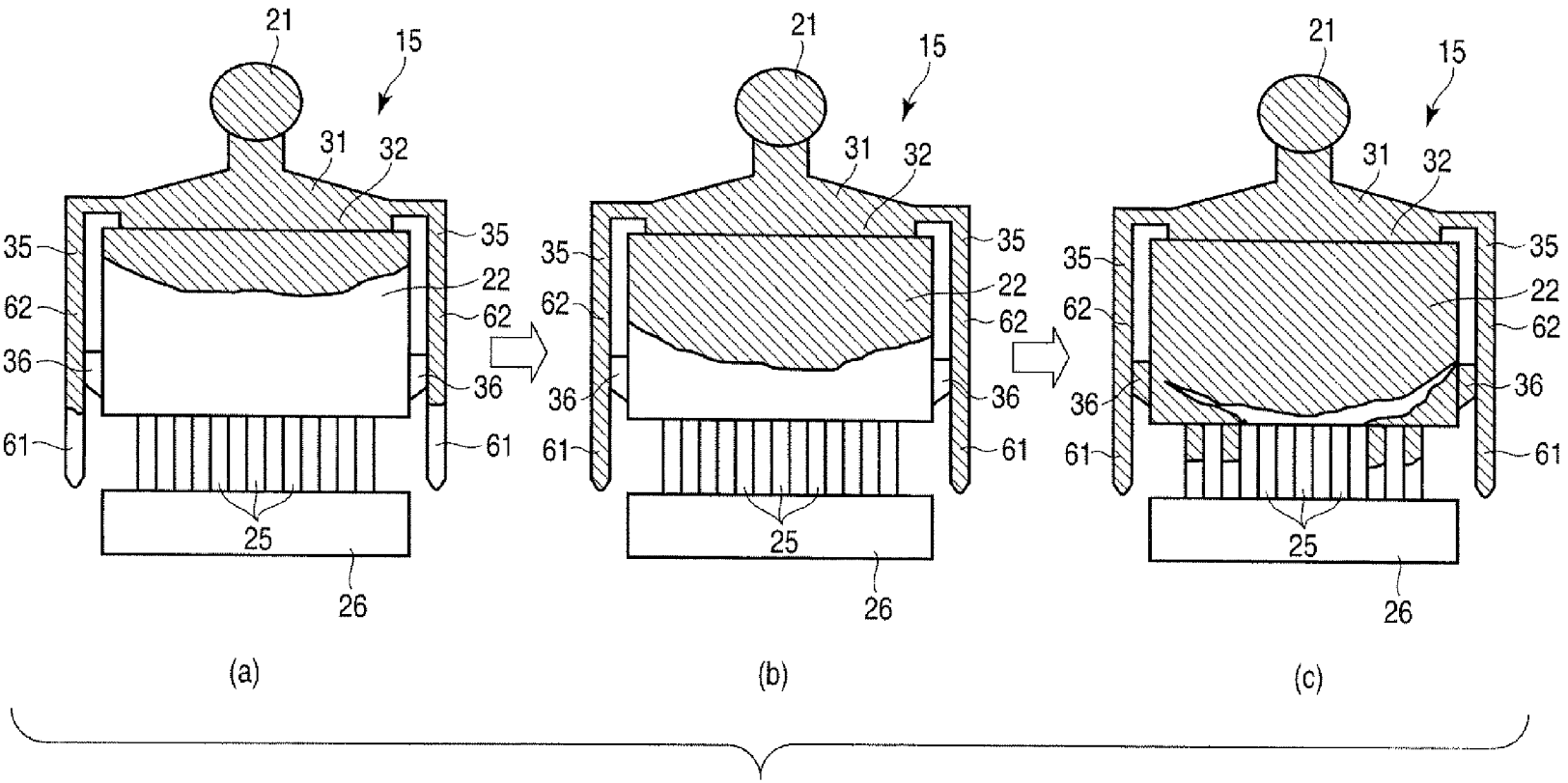
FIG. 4 is an exemplary view schematically showing molten metal filling processes for the die shown in FIG. 1.

FIG. 4 shows processes for filling the molten metal into the die 1. In FIG. 4, a hatched portion represents a region in which the molten metal filling is advanced.

In FIG. 4, (*a*) shows the internal space 15 of the die in an Initial stage of filling. As shown in (a) of FIG. 4, the molten metal that is forced into the biscuit section 21 is first filled into the main runner 31 that has a relatively large cross-sectional flow area. Then, the molten metal flows Into the sub-runners 35, which also have a relatively large cross-sectional flow area, and starts to be filled into the product section 22 through the main gate 32 that connects directly with the main runner 31.

As shown in (a) of FIG. 4, the molten metal that flows through the sub-runners 35 does not immediately flows into the sub-gates 36 when it reaches inlets of the sub-gates 36, and most of the molten metal flows toward the extension parts 61 of the sub-runners 35. This is because the molten metal that is injected at a high speed forms a strong inertial flow and because the sub-gates 36 are smaller in cross-sectional flow area and higher in flow resistance than the sub-runners 35.

In FIG. 4, (*b*) shows the internal space 15 of the die in an intermediate stage of filling. As shown in (b) of FIG. 4, the molten metal having flowed into the sub-runners 35 hardly flows into the sub-gates 36, and filling of the molten metal into the extension parts 61 of the sub-runners 35 is advanced. While the filling of the molten metal into the extension parts 61 without substantially flowing into the sub-gates 36 is advanced, the molten metal flows from the main gate 32 into the product section 22. As the filling of the molten metal from the main gate 32 into the product section 22 advances, air in the product section 22 is gradually pushed out into the overflow section 25, thereby expanding a filling region therein.

In FIG. 4, (*c*) shows the internal space 15 of the die in a later stage of filling. When the extension parts 61 of the sub-runners 35 are filled, as shown in (c) of FIG. 4, the molten metal in the sub-gates 36 flows into the sub-gates 36. Thereupon, filling of the molten metal from the sub-gates 36 into the product section 22 is substantially started.

The molten metal introduced through the main gate 32 is filled into a relatively deep part of the product section 22. The molten metal introduced through the sub-gates 36 joins the molten metal introduced through the main gate 32 in regions relatively close to the overflow section 25. Thus, escapes for air which lead to the overflow section 25 are left at junctions between the molten metal introduced through the sub-gates 36 and the molten metal introduced through the main gate 32.

Thus, the air in the product section 22 cannot be easily left between the molten metal introduced through the sub-gates 36 and the molten metal introduced through the main gate 32 and can be suitably discharged into the overflow section 25. Since the filling volumes of the sub-runners 35 are increased by the extension parts 61, moreover, the energy of filling from sub-runners 35 into the product section 22 is damped. Thus, interference between the molten metal introduced through the sub-gates 36 and the molten metal introduced through the main gate 32 is reduced.

Figure 7:
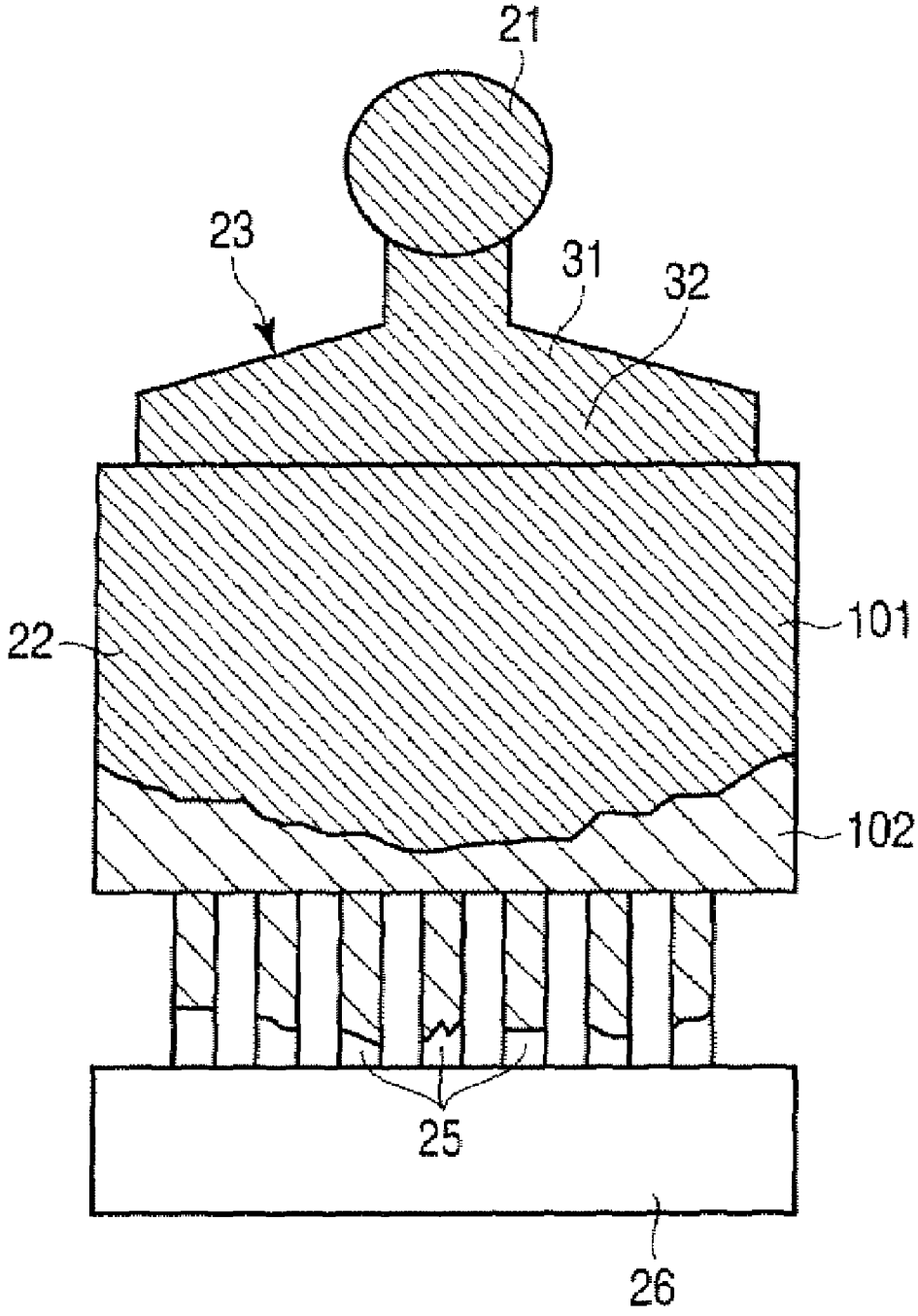
FIG. 7 is an exemplary view schematically showing an internal space of a die without sub-gates.

According to the die 1 and the method of manufacturing the cast product arranged in this manner, defective casting can be reduced. FIG. 7 shows a die that is provided with neither sub-runners nor sub-gates for convenience of explanation. In casting a thin-walled product with the fundamental thickness of, for example, 0.6 mm or less, the cross-sectional flow area of the product section is small, and the molten metal introduced through the fan gate 23 alone cannot ensure a satisfactory flow rate. Therefore, defective casting is caused in many cases.

More specifically, the molten metal at the flow tip is soiled by a release agent or the like and must be discharged to the outside of the product section 22. Essentially, therefore, the molten metal must also be filled into the overflow section 25, as well as into the entire product section 22.

In casting a thin-walled product with the fundamental thickness of, for example, 0.6 mm or less, however, the cross-sectional flow area is small, and the time for the solidification of the molten metal of, for example, a magnesium alloy is very short. Therefore, it is difficult to secure required fluidity for filling, and insufficient filling occurs frequently.

FIG. 7 shows an example of the die that suffers insufficient filling. In FIG. 7, a densely hatched portion represents a well-filled part 101 that is filled with a sufficient density. In FIG. 7, a coarsely hatched portion represents an ill-filled part 102 that is not sufficiently filled and is low in density. Thus, in the die with neither sub-runners nor sub-gates, the product section 22 involves the ill-filled part, so that there is a high possibility of the die becoming a defective. The die of this type, liable to insufficient filling, requires the following flow-supporting sub-gates.

Figure 8:
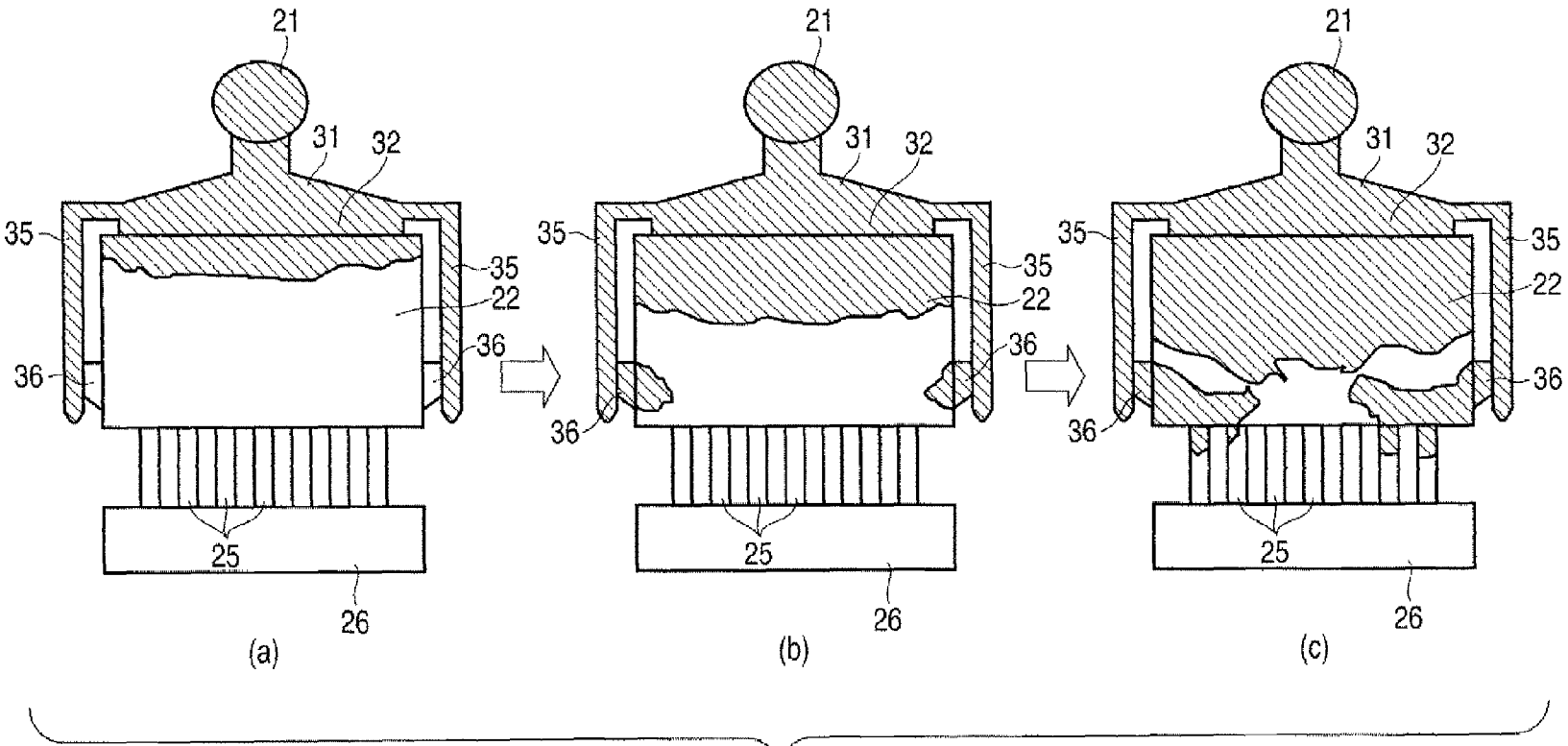
FIG. 8 is an exemplary view schematically showing molten metal filling processes for a die with sub-runners not extending beyond a product section.

FIG. 8 shows filling processes for a die that is provided with sub-gates 36 and sub-runners 35, the sub-runners 35 not extending beyond a product section 22 though. The sub-gates 36 and the sub-runners 35 arranged in this manner may be expected to solve the insufficient filling. However, the inventor hereof found that the sub-runners 35 and the sub-gates 36 of this configuration cause the following problem to the casting of the thin-walled product with the fundamental thickness of, for example, 0.6 mm or less.

In FIG. 8, (*a*) shows an internal space 15 of the die in an initial stage of filling. When filling is started, a main runner 31 with a large cross-sectional flow area and the sub-runners 35 are filled first. In FIG. 8, (*b*) shows the internal space 15 of the die in an intermediate stage of filling. When filling the sub-runners 35 is completed, a molten metal in the sub-runners 35 flows into a product section 22 through the sub-gates 36.

In casting a thin-walled product with the fundamental thickness of, for example, 0.6 mm or less, the flow resistance of the stationary die 2 is so high that the molten metal in the product section 22 flows slower than in the case where the fundamental thickness exceeds 0.6 mm. As shown in (b) of FIG. 8, therefore, the product section 22 is hardly filled with the molten metal introduced through a main gate 32 when the molten metal starts to flow into the product section 22 through the sub-gates 36.

In FIG. 8, (*c*) shows the internal space 15 of the die in a later stage of filling. When the filling of the molten metal into the product section 22 through the sub-gates 36 is started with the product section 22 hardly filled with the molten metal introduced through the main gate 32, the molten metal introduced through the sub-gates 36 and the molten metal introduced through the main gate 32 severely interfere with each other in the product section 22, as shown in (c) of FIG. 8.

Further, there is no escape for air that is sandwiched between the molten metal introduced through the sub-gates 36 and the molten metal introduced through the main gate 32, so that incomplete fusion involving gas inclusion occurs. In consequence, defective casting, called mold cavities, incomplete filling, or molten metal wrinkles, is liable to occur. The molten metal wrinkles, which are also called cold shut, are patterns that remain on the surface of a cast product.

In the die 1 according to the present embodiment, on the other hand, each sub-runner 35 includes the extension part 61 that extends beyond the product section 22. Thus, the timing (so-called filling timing) for the start of injection into the product section 22 through the sub-gates 36 can be delayed. Specifically, an adjustment can be made to delay the timing for the injection start for a required time by suitably setting the length of the extension parts 61.

The molten metal introduced through the sub-gates 36 and the molten metal introduced through the main gate 32 can be joined in regions relatively close to the overflow section 25 by delaying the timing for the start: of injection into the product section 22 through the sub-gates 36, that is, by starting injection into the product section 22 through the sub-gates 36 at a point of time when filling of the product section 22 through the main gate 32 is sufficiently advanced. Thus, air in the product section 22 can be smoothly discharged to reduce defective casting that is attributable to gas inclusion.

Further, the extension parts 61 serve to increase the filling volumes of the sub-runners 35, thereby damping the energy of filling of the product section 22 through the sub-gates 36. Thus, the interference between the molten metal introduced through the sub-gates 36 and the molten menu 1 introduced through the main gate 32 can be reduced, so that turbulent flows or the like attributable to the interference can be suppressed. This contributes to the reduction of the defective casting. In other words, casting of a thin-walled product that is liable to insufficient filling can be performed without depending on high-speed injection, so that the life of the die can be prolonged.

Since the molten metal is filled into the die 1 in a very short time of, for example, $2/1{,}000$ second, the timing for the start of injection through the sub-gates 36 can be satisfactorily adjusted by means of the extension parts 61 on the sub-runners 35.

In order to delay the timing for the start of injection into the product section 22 through the sub-gates 36, the cross-sectional flow area may be reduced for adjustment by partially plugging the sub-runners 35. However, this adjustment is very troublesome, requiring operations to remove the die 1 from the casting machine, plug the sub-runners 35, and then finish the resulting structure by machining. This may possibly prolong the construction period, since a plurality of casting trials are required before an optimum timing for the filling through the sub-gates 36 is obtained.

If the timing for the extension of the sub-runners 35 beyond the product section 22 is adjustable, on the other hand, the timing for the filling through the sub-gates 36 can be delayed by only performing machining work alone, without involving the troublesome operation to partially plug the sub-runners 35, etc. Further, the timing for the filling through the sub-gates 36 can be gradually delayed for adjustment by lengthening the extension parts 61 of the sub-runners 35 bit by bit. Due to a lighter load, the timing adjustment operation can be performed more easily for an operation to cut the die so as to lengthen the extension parts 61 than for the operation to plug the sub-runners 35.

Second Embodiment

A die 1 and a method of manufacturing a cast product according to a second embodiment of the present invention will now be described with reference to FIG. 5. Like numbers are used to designate configurations with like or similar functions to those of the configurations of the first embodiment, and a description of those configurations is omitted.

Figure 5:
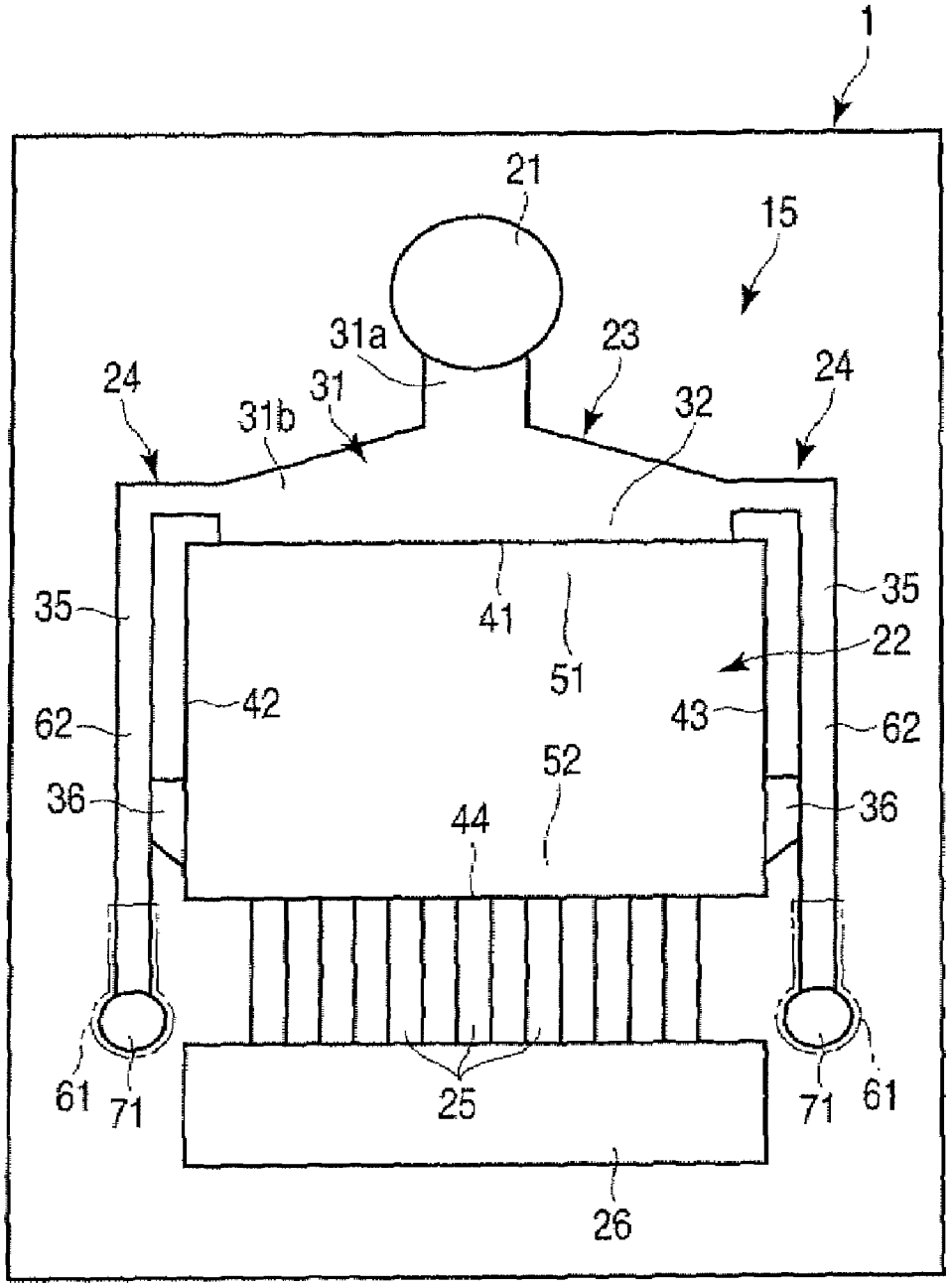
FIG. 5 is an exemplary view schematically showing the structure of an internal space of a die according to a second embodiment of the invention.

In the die 1 according to the present embodiment, as shown in FIG. 5, a molten metal head 71 is provided on the distal end portion of an extension part 61 of each of sub-runners 35. The molten metal heads 71 are spaces defined in the die 1 and are filled with a molten metal that flows through the sub-runners 35 in a filling process. The heads 71 serve to increase the filling volumes of the sub-runners 35. Each head 71 is not limited to a specific shape and may be of any of various shapes, such as a circular or box-like shape. For other arrangements, the die 1 and the cast product manufacturing method of the present embodiment are the same as those of the first embodiment.

According to the die 1 and the cast product manufacturing method arranged in this manner, the timing for filling of a product section 22 through sub-gates 36 can be delayed, so that defective casting can be reduced, as in the first embodiment.

If the molten metal heads 71 are provided on the respective distal ends of the sub-runners 35, the timing for filling of the product section 22 through the sub-gates 36 can be further delayed, so that the adjustable range for the filling timing is widened.

Third Embodiment

A die 1 and a method of manufacturing a cast product according to a third embodiment of the present invention will now be described with reference to FIG. 6. Like numbers are used to designate configurations with like or similar functions to those of the configurations of the first embodiment, and a description of those configurations is omitted.

Figure 6:
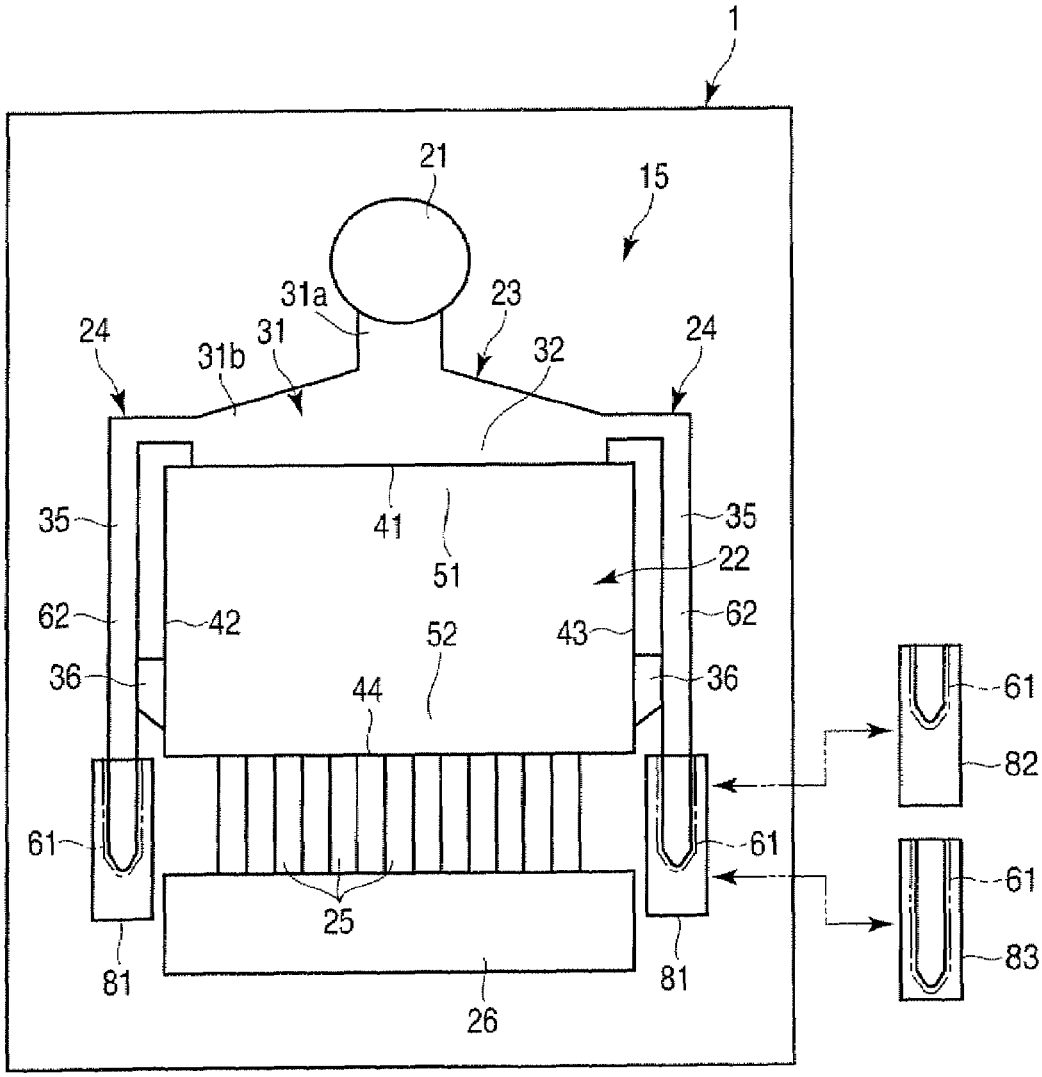
FIG. 6 is an exemplary view schematically showing the structure of an internal, space of a die according to a third embodiment of the invention.

In the die 1 according to the present embodiment, as shown in FIG. 6, an extension part 61 of each of sub-runners 35 has a telescopic structure. Specifically, a region Including the extension part 61 is unitized as a liner 81 (i.e., a replaceable piece) for the die 1, and the liner 81 is replaceable with another liner 82 or 83 that forms a sub-runner 35 of a different shape (ex., a different length). Thus, the filling volume of each sub-runner 35 can be changed by replacing the liner 81 with the alternative liner 82 or 83. For other arrangements, the die 1 and the cast product manufacturing method of the present embodiment are the same as those of the first embodiment.

According to the die 1 and the cast product manufacturing method arranged in this manner, the timing for filling of a product section 22 through sub-gates 36 can be delayed, so that defective casting can be reduced, as in the first embodiment.

If the extension part 61 of each sub-runner 35 has the replaceable structure and if the liner 81 is replaceable with the alternative liner 82 or 83 that forms each sub-runner 35 of the different shape, the timing for filling of the product section 22 through the sub-gates 36 can be easily changed by suitably replacing the liners 81, 82 and 83 with one another. Thus, a broad tendency of the filling timing can be grasped by this unit replacement, for example, and data as a basis of later fine adjustments can be obtained with ease.

Although the dies 1 and the cast product manufacturing methods according to the first to third embodiments of the present invention have been described herein, the invention is not limited to these embodiments. In carrying out the invention, its components may be embodied in modified forms without departing from the scope or spirit of the invention.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes In the form of the methods and systems described herein may be made without departing from the spirit of the inventions. The accompanying claims and their equivalents are intended to cover such forms or modifications as would fall within the scope and spirit of the inventions.

What is claimed is:

1. A die for die casting, comprising:

a stationary die; and a movable die to be combined with the stationary die, a plurality of elements are situated between the stationary die and the movable die when the movable die is combined with the stationary die, the plurality of the elements comprise (i) a biscuit section configured to receive a molten metal from an injection apparatus of a casting machine, (ii) a product section in which a product is to be case, the product section including a main edge part, and a side edge part extending from an end portion of the main edge part, (iii) a main runner configured to guide the molten metal from the biscuit section toward the main edge part of the product section, (iv) a main gate provided between the main edge part of the product section and having a thickness smaller than that of the main runner, (v) a sub-runner diverging from the main runner and extending along the side edge part of the product section, and (vi) a sub-gate provided between the sub-runner and the side edge part of the product section and having a thickness smaller than that of the sub-runner, wherein the product section including a first end portion connecting with the main gate and a second end portion as an end portion of the product section opposite from the first end portion, the sub-gate being connected to the side edge part in the second end portion of the product section, the sub-runner extending beyond the product section in a direction in which the side edge part extends, a part of the sub-runner extending beyond the product section being unitized as a liner replaceable with another liner which forms a sub-runner of a different shape.

2. A method of manufacturing a cast product by die casting, comprising:

preparing a die which includes a stationary die and a movable die to be combined with the stationary die, the die being configured so that (i) a biscuit section configured to receive a molten metal from an injection apparatus of a casting machine, (ii) a product section in which a product is to be cast, the product section including a main edge part, and a side edge part extending from an end portion of the main edge part, (iii) a main runner configured to guide the molten metal from the biscuit section toward the main edge part of the product section, (iv) a main gate provided between the main runner and the main edge part of the product section and having a thickness smaller than that of the main runner, (v) a sub-runner diverging from the main runner and extending along the side edge part of the product section, and (vi) a sub-gate provided between the sub-runner and the side edge part of the product section and having a thickness smaller than that of the sub-runner are formed between the stationary die and the movable die when the movable die is combined with the stationary die, wherein the product section including a first end portion connecting with the main gate and a second end portion as an end portion of the product section opposite from the first end portion, the sub-gate being connected to the side edge part in the second end portion of the product section, the sub-runner extending beyond the product section in a direction in which the side edge part extends, a part of the sub-runner extending beyond the product section being unitized as a liner replaceable with another liner which forms a sub-runner of a different shape;

combining the movable die with the stationary die; and infusing the molten metal into the biscuit section.

* * * * *